US012622465B2

(12) United States Patent
Lei et al.

(10) Patent No.: US 12,622,465 B2
(45) Date of Patent: May 12, 2026

(54) ELECTRONIC VAPORIZATION ASSEMBLY AND DEVICE THEREOF

(71) Applicant: SHENZHEN SMOORE TECHNOLOGY LIMITED, Guangdong (CN)

(72) Inventors: Guilin Lei, Shenzhen (CN); Ru Jiang, Shenzhen (CN); Rui Cao, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 544 days.

(21) Appl. No.: 18/174,262

(22) Filed: Feb. 24, 2023

(65) Prior Publication Data

US 2023/0200450 A1 Jun. 29, 2023

Related U.S. Application Data

(63) Continuation of application No. PCT/CN2020/112674, filed on Aug. 31, 2020.

(51) Int. Cl.
*A24F 40/485* (2020.01)
*A24F 40/10* (2020.01)
(Continued)

(52) U.S. Cl.
CPC ..... *A24F 40/485* (2020.01); *A24F 40/10* (2020.01); *A24F 40/42* (2020.01); *A24F 40/44* (2020.01); *A24F 40/46* (2020.01)

(58) Field of Classification Search
None
See application file for complete search history.

(56) References Cited

U.S. PATENT DOCUMENTS

2013/0306064 A1* 11/2013 Thorens ..... A24F 40/485 128/202.21
2014/0109921 A1 4/2014 Chen
(Continued)

FOREIGN PATENT DOCUMENTS

CN 203523810 U 4/2014
CN 105105339 A 12/2015
(Continued)

OTHER PUBLICATIONS

English Translation obtained from Espacenet, pp. 1-13 (Year: 2015).*
(Continued)

*Primary Examiner* — Philip Y Louie
*Assistant Examiner* — Madeleine P Delacruz
(74) *Attorney, Agent, or Firm* — Leydig, Voit & Mayer, Ltd.

(57) ABSTRACT

An electronic vaporization assembly includes: a vaporization core having a heating element and a vaporization core body, the vaporization core body having a porous structure; a vaporization base having a vaporization top base, a vaporization bottom base, and a microgroove structure, the vaporization top base and the vaporization bottom base forming a vaporization cavity, the vaporization core being fixed between the vaporization top base and the vaporization bottom base, the microgroove structure including a plurality of microgrooves, and the plurality of microgrooves being provided on a surface of at least one of the vaporization top base and the vaporization bottom base in contact with the vaporization core body; and a liquid storage tank sleeved on the vaporization base.

8 Claims, 7 Drawing Sheets

(51) Int. Cl.

| | |
|---|---|
| ***A24F 40/42*** | (2020.01) |
| ***A24F 40/44*** | (2020.01) |
| ***A24F 40/46*** | (2020.01) |
| ***A24F 40/48*** | (2020.01) |

(56) References Cited

U.S. PATENT DOCUMENTS

| | | | | |
|---|---|---|---|---|
| 2016/0073694 | A1 | 3/2016 | Liu | |
| 2017/0325503 | A1 | 11/2017 | Liu | |
| 2019/0231991 | A1 | 8/2019 | Tsai et al. | |
| 2020/0060344 | A1 | 2/2020 | Tan et al. | |
| 2021/0219606 | A1 | 7/2021 | Lahound et al. | |
| 2021/0345670 | A1* | 11/2021 | Wang | A24F 40/42 |
| 2023/0240360 | A1* | 8/2023 | Xie | A24F 40/42 131/329 |

FOREIGN PATENT DOCUMENTS

| | | | |
|---|---|---|---|
| CN | 208550022 | U | 3/2019 |
| CN | 110250578 | A | 9/2019 |
| CN | 110403246 | A | 11/2019 |
| CN | 110613171 | A | 12/2019 |
| CN | 110613172 | A | 12/2019 |
| CN | 110623308 | A | 12/2019 |
| CN | 110638101 | A | 1/2020 |
| CN | 110893016 | A | 3/2020 |
| CN | 111109664 | A | 5/2020 |
| CN | 210471007 | U | 5/2020 |
| CN | 112021671 | A | 12/2020 |
| CN | 212728792 | U | 3/2021 |
| CN | 212937921 | U | 4/2021 |
| CN | 113786011 | A | 12/2021 |
| DE | 102017123869 | A1 | 4/2019 |
| KR | 1020200070268 | A | 6/2020 |
| WO | 2015043126 | A1 | 4/2015 |
| WO | 2015161407 | A1 | 10/2015 |
| WO | 2018054064 | A1 | 3/2018 |
| WO | 2022041241 | A1 | 3/2022 |

OTHER PUBLICATIONS

European Patent Office, Search Report in European Patent Application No. 20950910.8 (Feb. 5, 2024).

Chinese Patent Office, Office Action in Chinese Patent Application No. 202010899227.X (Sep. 26, 2024).

Chinese Patent Office, Office Action in Chinese Patent Application No. 202010899246.2 (Oct. 8, 2024).

European Patent Office, Search Report in European Patent Application No. 20950911.6 (Oct. 11, 2023).

Patent Cooperation Treaty, International Search Report and Written Opinion, International Application No. PCT/CN2020/112672 (May 28, 2021).

Patent Cooperation Treaty, International Search Report and Written Opinion, International Application No. PCT/CN2021/113841 (Apr. 28, 2022).

Patent Cooperation Treaty, International Search Report and Written Opinion, International Application No. PCT/CN2020/112674 (May 26, 2021).

Chinese Patent Office, First Office Action in Chinese Patent Application No. 202121975643.X (Feb. 9, 2022).

* cited by examiner

ELECTRONIC VAPORIZATION ASSEMBLY AND DEVICE THEREOF

CROSS-REFERENCE TO PRIOR APPLICATION

This application is a continuation of International Patent Application No. PCT/CN2020/112674, filed on Aug. 31, 2020. The entire disclosure is hereby incorporated by reference herein.

FIELD

The present disclosure relates to the field of vaporizer technologies, and specifically, to an electronic vaporization assembly and a device thereof.

BACKGROUND

An electronic vaporization device includes an electronic vaporization assembly and a power supply component, where the electronic vaporization assembly vaporizes e-liquid, and the power supply component is configured to supply power to the electronic vaporization assembly. In the electronic vaporization assembly, an excessive large amount of e-liquid from a liquid storage tank flowing into a vaporization core through a liquid flowing channel may cause a liquid leakage problem; and an excessive small amount of e-liquid may cause problems such as e-liquid explosion and a burnt flavor. That is, a liquid supplying amount has a significant impact on the performance of the electronic vaporization device.

SUMMARY

In an embodiment, the present invention provides an electronic vaporization assembly, comprising: a vaporization core comprising a heating element and a vaporization core body, the vaporization core body having a porous structure; a vaporization base comprising a vaporization top base, a vaporization bottom base, and a microgroove structure, the vaporization top base and the vaporization bottom base forming a vaporization cavity, the vaporization core being fixed between the vaporization top base and the vaporization bottom base, the microgroove structure comprising a plurality of microgrooves, and the plurality of microgrooves being provided on a surface of at least one of the vaporization top base and the vaporization bottom base in contact with the vaporization core body; and a liquid storage tank sleeved on the vaporization base.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
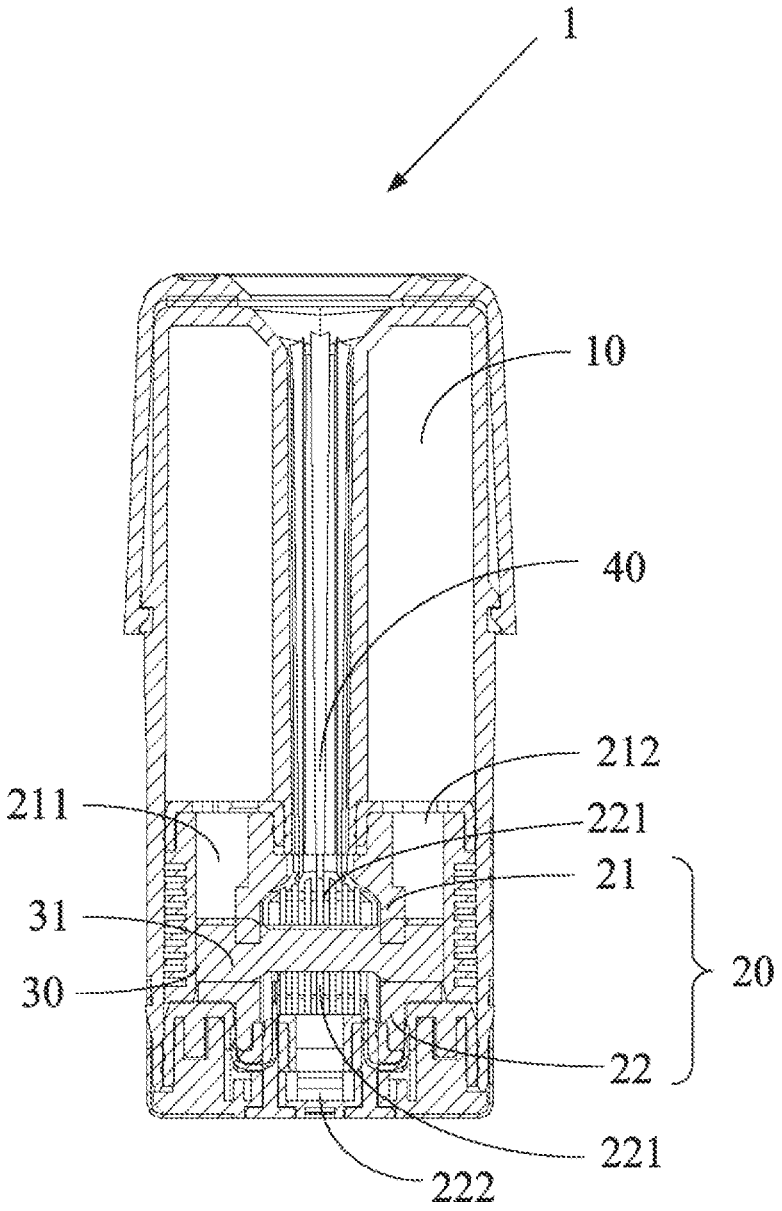
FIG. 1 is a schematic structural diagram of an electronic vaporization assembly according to the present disclosure.

In an embodiment, the present invention provides an electronic vaporization assembly and a device thereof, to resolve a problem of controlling a liquid supplying amount in the related art.

In an embodiment, the present invention provides an electronic vaporization assembly, including a vaporization core, a vaporization base, and a liquid storage tank, where the vaporization core includes a heating element and a vaporization core body, and the vaporization core body has a porous structure; the vaporization base includes a vaporization top base and a vaporization bottom base; the vaporization core is arranged between the vaporization top base and the vaporization bottom base; and a microgroove structure is provided on the surface of the vaporization base that is in contact with the vaporization core body, where the microgroove structure includes multiple microgrooves, and the liquid storage tank is sleeved on the vaporization base.

A first groove is provided on the vaporization top base, an upper part of a vaporization cavity and a liquid flowing channel are provided on the bottom wall of the first groove; and the microgroove structure is provided on the bottom wall of the first groove, where the microgroove structure is provided on the bottom surface between an inhalation channel and the liquid flowing channel.

One end of each of the multiple microgrooves is in communication with the liquid flowing channel, and the other end extends in a direction that is close to the inhalation channel.

The microgroove structure is provided on the side wall of the first groove.

A vaporization cavity is provided on the vaporization bottom base, a second groove and a third groove are respectively provided on two sides of the vaporization cavity, and the microgroove structure is provided on the bottom walls of the second groove and the third groove.

One end of the microgroove that is provided on the vaporization bottom base is in communication with the vaporization cavity, and the other end extends in a direction that is away from the vaporization cavity.

The microgroove structure is provided on the side walls of the second groove and the third groove.

The multiple microgrooves are parallel to each other, or the multiple microgrooves intersect with each other.

The width of each of the multiple microgrooves is less than 1 mm; and the section of each of the multiple microgrooves is semicircular, rectangular, or triangular.

The vaporization core body is a cotton core or a porous ceramic.

To resolve the foregoing technical problems, a second technical solution provided in the present disclosure is to provide an electronic vaporization device, including an electronic vaporization assembly and a power supply component, where the electronic vaporization assembly is the electronic vaporization assembly according to any one of the foregoing.

Beneficial effects of the present disclosure are as follows: different from the related art, in the present disclosure, by providing a microgroove structure on the surface of a vaporization base that is in contact with a vaporization core body, a fine adjustment on a liquid supplying amount of e-liquid that enter a vaporization core is achieved, thereby achieving a precise control over a liquid supplying amount of different products, avoiding liquid leakage of the vaporization core caused by an excessive large amount of liquid supplying and e-liquid explosion or a burnt flavor caused by an excessive small amount of liquid supplying, and improving the performance of the electronic vaporization device.

The present disclosure is further described in detail below with reference to the accompanying drawings and embodiments. It is specifically noted that the following embodiments are only intended to illustrate the present disclosure and are not intended to limit the scope thereof. Similarly, the following embodiments are merely some rather than all of the embodiments of the present disclosure, and all other embodiments obtained by a person of ordinary skill in the art without creative efforts shall fall within the protection scope of the present disclosure.

The terms "first", "second", and "third" in the present disclosure are used for descriptive purposes only and should not be construed as indicating or implying relative importance or implicitly indicating the number of technical features indicated. Therefore, features defined by "first", "second", or "third" may explicitly indicate or implicitly include at least one of the features. In the descriptions of the present disclosure, unless otherwise specified, "multiple" means two or more than two, for example, two or three. All directional indications (for example, up, down, left, right, front, back) in the embodiments of the present disclosure are only used for explaining relative position relationships, movement situations, or the like between various components in a specific posture (as shown in the accompanying drawings). If the specific posture changes, the directional indications change accordingly. In the embodiments of the present disclosure, terms "include", "comprise", and any variations thereof are intended to cover non-exclusive inclusion. For example, a process, method, system, product, or device that includes a series of steps or units is not limited to the listed steps or units; and instead, further optionally includes a step or unit that is not listed, or further optionally includes another step or component that is intrinsic to the process, method, product, or device.

Embodiment mentioned in the specification means that particular features, structures, or characteristics described with reference to the embodiment may be included in at least one embodiment of the present disclosure. The term appearing at different positions of the specification may not refer to the same embodiment or an independent or alternative embodiment that is mutually exclusive with another embodiment. A person skilled in the art explicitly or implicitly understands that the embodiments described in the specification may be combined with other embodiments.

Figure 2:
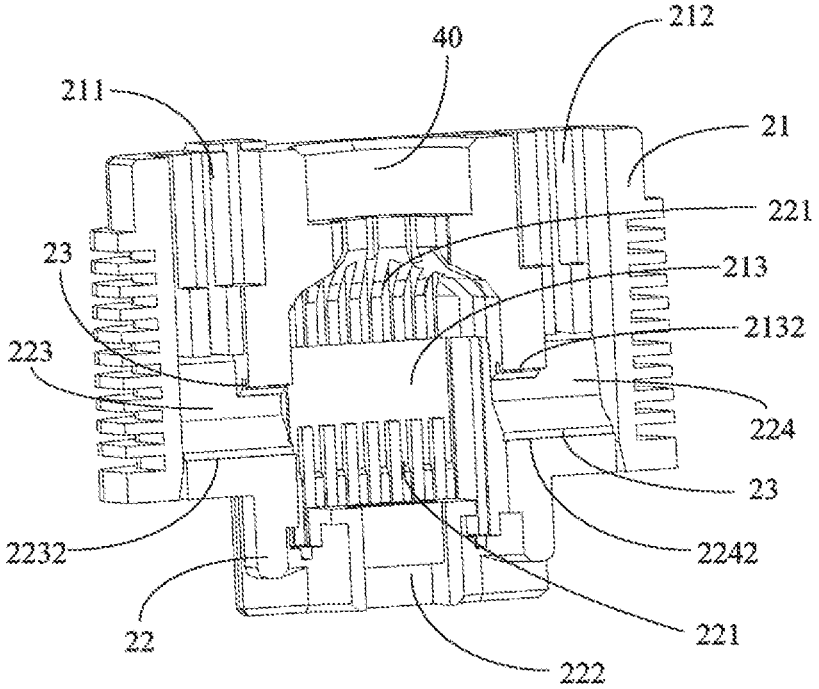
FIG. 2 is a schematic cross-sectional view of a vaporization base of an electronic vaporization assembly according to the present disclosure.

Referring to FIG. 1 and FIG. 2, FIG. 1 is a schematic structural diagram of an electronic vaporization assembly 1 according to the present disclosure, and FIG. 2 is a schematic cross-sectional view of a vaporization base 20 of the electronic vaporization assembly 1 according to the present disclosure.

The electronic vaporization assembly 1 includes a liquid storage tank 10, a vaporization base 20, and a vaporization core 30. The electronic vaporization assembly 1 specifically may be configured to vaporize liquid and generate vapor that are applied to different fields, such as medical treatment, electronic cigarettes, and the like. In a specific embodiment, the electronic vaporization assembly 1 may be applied to an electronic cigarette vaporization device to vaporize e-liquid and generate vapor for inhalation by an inhaler, which is used as an example in all the following embodiments. Certainly, in other embodiments, the electronic vaporization assembly 1 may also be applied to a hair spray device to vaporize hair spray that is used for hair styling; or be applied to a medical device that treats upper and lower respiratory system diseases, and vaporizes medical drugs.

The liquid storage tank 10 is sleeved on the vaporization base 20, and is configured to store e-liquid. The liquid storage tank 10 may be made of aluminum, stainless steel, or other metals, provided that the liquid storage tank can store e-liquid without reacting with the e-liquid to cause the e-liquid to deteriorate; and a shape and size of the liquid storage tank 10 are not limited, which may be designed as required.

The vaporization base 20 includes a vaporization top base 21 and a vaporization bottom base 22. The vaporization base 20 may be made of ceramics, stainless steel or other alloys, provided that the vaporization base can provide support; and a shape and size of the vaporization base 20 are not limited, which may be designed as required.

The vaporization core 30 is arranged between the vaporization top base 21 and the vaporization bottom base 22, and the vaporization core 30 includes a vaporization core body 31 and a heating element, where the vaporization core body 31 warps the heating element. The vaporization core body 31 has a porous structure. A material of the vaporization core body 31 is a cotton core or a porous ceramic. Since the vaporization core body 31 has a porous structure, the vaporization core body 31 can form a capillary action. After the vaporization core body 31 is in contact with the e-liquid in the liquid storage tank 10, the e-liquid can reach the heating element inside the vaporization core body 31 through the vaporization core body 31, and is further vaporized under the action of the heating element.

A first groove is provided on the vaporization base 22 to form a lower part of a vaporization cavity 221; and a first through hole is provided on the bottom wall of the vaporization cavity 221 to form an air inlet channel 222, where the air inlet channel 222 is in communication with the vaporization cavity 221, so that the air inlet channel 222 is in communication with the outside and the vaporization cavity 221. A second through hole and a third through hole are provided on the vaporization top base 21 to form a first liquid flowing channel 211 and a second liquid flowing channel 212 respectively, so that the e-liquid in the liquid storage tank 10 enters the vaporization core 30 through the first liquid flowing channel 211 and the second liquid flowing channel 212, thereby achieving vaporization of the e-liquid. A fourth through hole is further provided on the vaporization top base 21 to form an upper part of the vaporization cavity 221.

The first liquid flowing channel 211 and the second liquid flowing channel 212 are provided on two sides of the vaporization cavity 221.

The electronic vaporization assembly 1 further includes an inhalation channel 40, where the inhalation channel 40 runs through the liquid storage tank 10 and is in communication with the outside and the vaporization cavity 221. External air enters the vaporization cavity 221 through the air inlet channel 222 to carry vapor in the vaporization cavity 221, and the vapor is then inhaled by a user through the inhalation channel 40.

Referring to FIG. 2, a second groove 213 is provided on the vaporization top base 21 and is configured to accommodate a part of the vaporization base 22, and the vaporization core 30 is arranged in the second groove 213. The first liquid flowing channel 211 and the second liquid flowing channel 212 are provided on the bottom wall 2132 of the second groove 213, so that the e-liquid enters the vaporization core 30; and the upper part of the vaporization cavity 221 is provided on the bottom wall 2132 of the second groove 213, so that vaporized e-liquid is inhaled by the user.

On the vaporization base 22, a third groove 223 and a fourth groove 224 are respectively provided on two sides of the lower part of the vaporization cavity 221, and the third groove 223 and the fourth groove 224 are through grooves. The third groove 223 and the fourth groove 224 have the same shape and size, and the side wall 2231 and the bottom wall 2232 of the third groove 223 are flush with the side wall 2241 and the bottom wall 2242 of the fourth groove 224.

The third groove 223 and the fourth groove 224 are in communication with the vaporization cavity 221, and the depth of the vaporization cavity 221 is greater than the depths of the third groove 223 and the fourth groove 224. The part of the vaporization base 22 on which the third groove 223 and the fourth groove 224 are provided is completely accommodated in the second groove 213, and the vaporization core 30 is connected to the third groove 223 and the fourth groove 224.

A microgroove structure 23 is provided on the surface of the vaporization base 20 that is in contact with the vaporization core body 31. Specifically, the microgroove structure 23 may be provided on the vaporization top base 21 and/or the vaporization bottom base 22.

The microgroove structure 23 can exert a guiding function on the e-liquid, or may finely adjust an amount of the e-liquid that enters the vaporization core 30. The microgroove structure 23 includes at least one microgroove.

The vaporization top base 21 and the vaporization bottom base 22 abut against the vaporization core 30, and are configured to fix the vaporization core 30. In a preferred embodiment, the vaporization core 30 may be deformed, such as a cotton core. During installation, the vaporization core 30 is squeezed, pressure at the part on which the microgroove structure 23 is arranged is smaller, and the vaporization core 30 partially extends into the microgroove.

Figure 3:
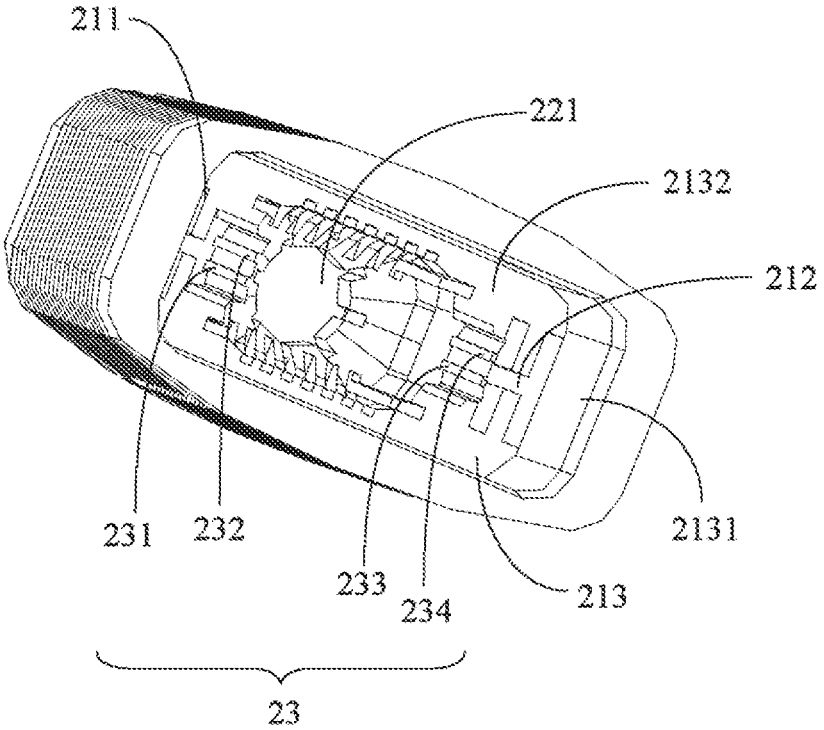
FIG. 3 is a schematic structural diagram of a vaporization top base in a first embodiment of an electronic vaporization assembly according to the present disclosure.

FIG. 3 is a schematic structural diagram of a vaporization top base 21 in a first embodiment of an electronic vaporization assembly 1 according to the present disclosure.

In the first embodiment, the second groove 213 of the vaporization top base 21 includes a first side wall 2131 and a bottom wall 2132. On the bottom wall 2132 of the second groove 213 of the vaporization top base 21, a microgroove structure 23 is provided between the first liquid flowing channel 211 and the vaporization cavity 221, and a microgroove structure 23 is provided between the second liquid flowing channel 212 and the vaporization cavity 221. The microgroove structure 23 may include one microgroove or multiple microgrooves. For example, the microgroove structure 23 includes four microgrooves.

The microgroove structure 23 that is provided on the bottom wall 2132 of the second groove 213 includes a first microgroove 231, a second microgroove 232, a third microgroove 233, and a fourth microgroove 234. The depths and widths of the first microgroove 231, the second microgroove 232, the third microgroove 233, and the fourth microgroove 234 are the same.

The first microgroove 231 and the second microgroove 232 are provided on the bottom surface between the first liquid flowing channel 211 and the vaporization cavity 221, and the first microgroove 231 and the second microgroove 232 are provided in parallel. One end of the first microgroove 231 and one end of the second microgroove 232 are in communication with the first liquid flowing channel 211, and the other ends extend in a direction close to the vaporization cavity 221, preferably, the other ends are in communication with the vaporization cavity 221. When the other ends of the first microgroove 231 and the second microgroove 232 are in communication with the vaporization cavity 221, e-liquid can be better guided to the heating element, but liquid leakage of the vaporization cavity 221 may occur; and when the other ends of the first microgroove 231 and the second microgroove 232 extend in the direction close to the vaporization cavity 221 and are not in communication with the vaporization cavity 221, a liquid guiding effect is not as good as that of being in communication with the vaporization cavity 221, but liquid leakage of the vaporization cavity 221 does not occur.

The third microgroove 233 and the fourth microgroove 234 are provided between the second liquid flowing channel 212 and the vaporization cavity 221, and the third microgroove 233 and the fourth microgroove 234 are provided in parallel. One end of the third microgroove 233 and one end of the fourth microgroove 234 are in communication with the second liquid flowing channel 212, and the other ends extend in the direction close to the vaporization cavity 221, preferably, the other ends are in communication with the vaporization cavity 221. When the other ends of the third microgroove 233 and the fourth microgroove 234 are in communication with the vaporization cavity 221, e-liquid can be better guided to the heating element, but liquid leakage of the vaporization cavity 221 may occur; and when the other ends of the third microgroove 233 and the fourth microgroove 234 extend in the direction close to the vaporization cavity 221 and are not in communication with the vaporization cavity 221, the liquid guiding effect is not as good as that of being in communication with the vaporization cavity 221, but liquid leakage of the vaporization cavity 221 does not occur.

The first microgroove 231 and the third microgroove 233 are collinear, and the second microgroove 232 and the fourth microgroove 234 are collinear.

Only one microgroove 231 may be provided on the microgroove structure 23 on the bottom wall 2132 of the second groove 213 of the vaporization top base 21, and the microgroove 231 may be provided between the first liquid flowing channel 211 and the vaporization cavity 221, or may be provided between the second liquid flowing channel 212 and the vaporization cavity 221.

Multiple microgrooves may be provided on the microgroove structure 23 on the bottom wall 2132 of the second groove 213 of the vaporization top base 21, and the number of microgrooves provided on the bottom surface between the first liquid flowing channel 211 and the vaporization cavity 221 and the number of microgrooves provided on the bottom surface between the second liquid flowing channel 212 and the vaporization cavity 221 may be the same or different. The microgrooves provided between the first liquid flowing channel 211 and the vaporization cavity 221 and the microgrooves provided between the second liquid flowing channel 212 and the vaporization cavity 221 may or may not be collinear; and the bottoms of the microgrooves that are provided between the liquid flowing channel 211 and the vaporization cavity 221 may or may not be flush with the bottoms of the microgrooves that are provided between the second liquid flowing channel 212 and the vaporization cavity 221. The microgrooves in the microgroove structure 23 may be linear or non-linear.

The shapes of the microgrooves 231 to 234 may be the same or different; the shapes of the microgrooves 231 to 234 may be one or a combination of a straight line, a curve, a T-shape, and an I-shape; and the microgrooves 231 to 234 are preferably in communication with the liquid flowing channel 211 or the liquid flowing channel 212 and the vaporization cavity 221. In this case, a capillary liquid guiding effect may be increased.

Figure 4:
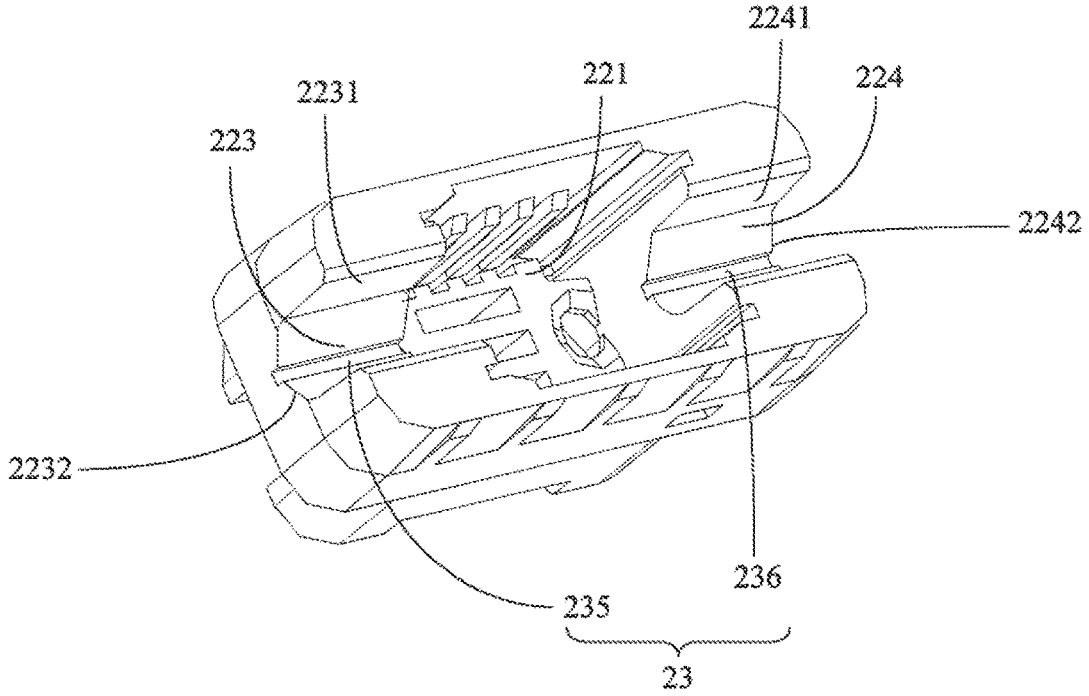
FIG. 4 is a schematic structural diagram of a vaporization bottom base in a first embodiment of an electronic vaporization assembly according to the present disclosure.

FIG. 4 is a schematic structural diagram of a vaporization bottom base 22 in a first embodiment of an electronic vaporization assembly 1 according to the present disclosure.

In the first embodiment, the third groove 223 on the vaporization base 22 includes a second side wall 2231 and a bottom wall 2232, and the fourth groove 224 on the vaporization base 22 includes a third side wall 2241 and a bottom wall 2242.

A microgroove structure 23 is provided on the bottom wall 2232 of the third groove 223 and the bottom wall 2242 of the fourth groove 224 of the vaporization bottom base 22. The microgroove structure 23 may include one microgroove or multiple microgrooves. A fifth microgroove 235 is provided on the bottom wall 2232 of the third groove 223, one end of the fifth microgroove 235 is in communication with the vaporization cavity 221, and the other end of the fifth microgroove 235 extends in a direction away from the vaporization cavity 221. Preferably, the fifth microgroove 235 is a through groove. A sixth microgroove 236 is provided on the bottom wall 2242 of the fourth groove 224, one end of the sixth microgroove 236 is in communication with the vaporization cavity 221, and the other end of the sixth microgroove 236 extends in the direction away from the vaporization cavity 221. Preferably, the sixth microgroove 236 is a through groove. The fifth microgroove 235 and the sixth microgroove 236 have the same depth and width, and the fifth microgroove 235 and the sixth microgroove 236 are collinear. When the fifth microgroove 235 and the sixth microgroove 236 are through grooves, since the part of the vaporization base 22 on which the third groove 223 and the fourth groove 224 are provided is completely accommodated in the second groove 213 of the vaporization top base 21, the fifth microgroove 235 and the sixth microgroove 236 are in communication with the first side wall 2131 of the second groove 213.

Multiple microgrooves may be provided on the bottom wall 2232 of the third groove 223 of the vaporization base 22, and the multiple microgrooves are parallel to each other. Multiple microgrooves may be provided on the bottom wall 2242 of the fourth groove 224 of the vaporization base 22, and the multiple microgrooves are parallel to each other. The number of microgrooves on the bottom wall 2232 of the third groove 223 and the number of microgrooves on the bottom wall 2242 of the fourth groove 224 may be the same or different; the microgrooves on the bottom wall 2232 of the third groove 223 and the microgrooves on the bottom wall 2242 of the fourth groove 224 may or may not be collinear; and the bottoms of the microgrooves on the bottom wall 2232 of the third groove 223 may or may not be flush with the bottoms of the microgrooves on the bottom wall 2242 of the fourth groove 224. The microgrooves provided on the bottom wall 2232 of the third groove 223 and the bottom wall 2242 of the fourth groove 224 of the vaporization base 22 may be linear or non-linear.

The shapes of the microgrooves 235 and 236 may be the same or different; the shapes of the microgrooves 235 and 236 may be one or a combination of a straight line, a curve, a T-shape, and an I-shape; and the microgrooves 235 and 236 are preferably through grooves. In this case, a capillary liquid guiding effect may be increased.

In other implementations, the microgroove structure 23 may only be provided on the bottom wall 2132 of the second groove 213 of the vaporization top base 21, or the microgroove structure 23 may only be provided on the bottom wall 2232 of the third groove 223 and the bottom wall 2242 of the fourth groove 224 of the vaporization base 22, or the microgroove structure 23 may be provided on the bottom wall 2132 of the second groove 213 of the vaporization base 21, the bottom wall 2232 of the third groove 223, and the bottom wall 2242 of the fourth groove 224 of the vaporization base 22.

Figure 5:
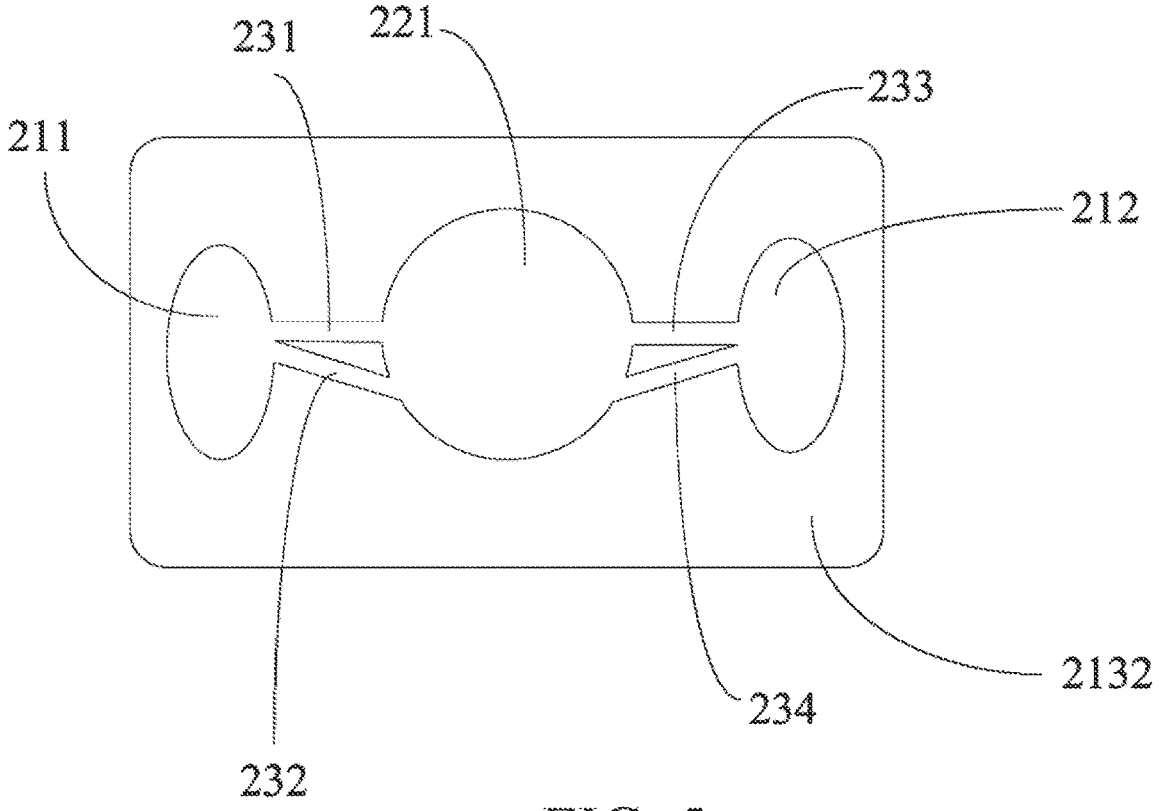
FIG. 5 is a schematic structural bottom view of a vaporization top base in a second embodiment of an electronic vaporization assembly according to the present disclosure.

FIG. 5 is a schematic structure bottom view of a vaporization top base 21 in a second embodiment of an electronic vaporization assembly 1 according to the present disclosure.

In the second embodiment, on the bottom wall 2132 of the second groove 213 of the vaporization top base 21, a first microgroove 231 and a second microgroove 232 are provided between the first liquid flowing channel 211 and the vaporization cavity 221. One end of the first microgroove 231 is in communication with the first liquid flowing channel 211, and the other end extends in a direction close to the vaporization cavity 221, where the other end of the first microgroove 231 may or may not be in communication with the vaporization cavity 221. One end of the second microgroove 232 is in communication with the first liquid flowing channel 211, and the other end extends in the direction close to the vaporization cavity 221, where the other end of the second microgroove 232 may or may not be in communication with the vaporization cavity 221. The first microgroove 231 intersects with the second microgroove 232, and an intersection point may be in communication with the vaporization cavity 221, or may be in communication with the first liquid flowing channel 211, or may be provided between the vaporization cavity 221 and the first liquid flowing channel 211. The first microgroove 231 and the second microgroove 232 have the same depth and width.

On the bottom wall 2132 of the second groove 213 of the vaporization top base 21, a third microgroove 233 and a fourth microgroove 234 are provided between the second liquid flowing channel 212 and the vaporization cavity 221. One end of the third microgroove 233 is in communication with the second liquid flowing channel 212, and the other end extends in the direction close to the vaporization cavity 221, where the other end of the third microgroove 233 may or may not be in communication with the vaporization cavity 221. One end of the fourth microgroove 234 is in communication with the second liquid flowing channel 212, and the other end extends in the direction close to the vaporization cavity 221, where the other end of the fourth microgroove 234 may or may not be in communication with the vaporization cavity 221. The third microgroove 233 intersects with the fourth microgroove 234, and an intersection point may be in communication with the vaporization cavity 221, or may be in communication with the second liquid flowing channel 212, or may be provided between the vaporization cavity 221 and the second liquid flowing channel 212. The third microgroove 233 and the fourth microgroove 234 have the same depth and width.

Figure 6:
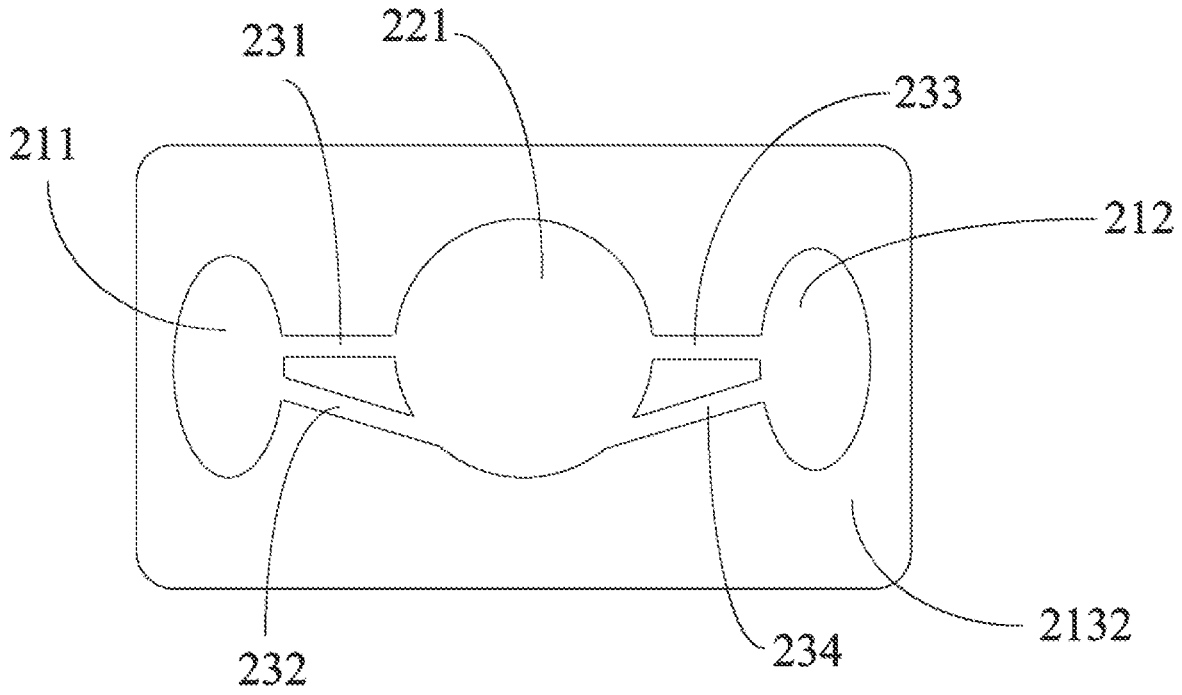
FIG. 6 is a schematic structural diagram of another implementation of a microgroove structure on a bottom wall of a second groove in a second embodiment of an electronic vaporization assembly according to the present disclosure.

FIG. 6 is a schematic structural diagram of another implementation of a microgroove structure 23 on a bottom wall 2132 of a second groove 213 in a second embodiment of an electronic vaporization assembly 1 according to the present disclosure.

Figure 7:
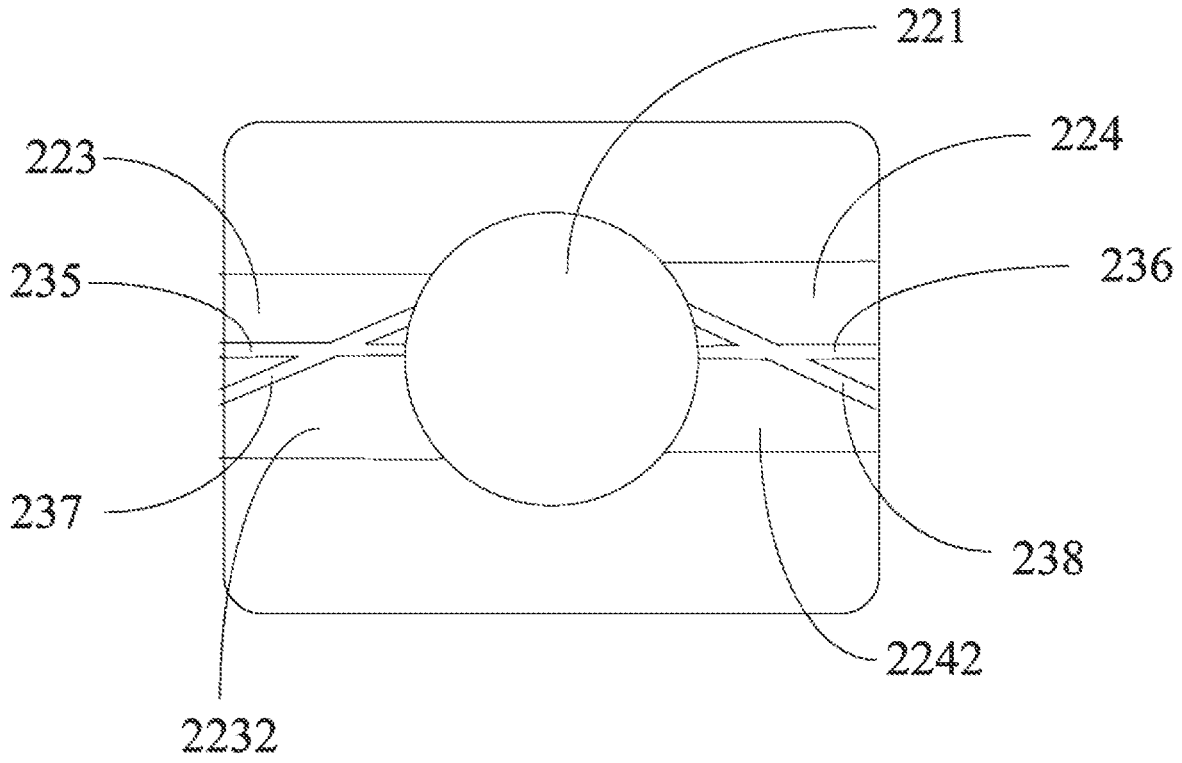
FIG. 7 is a schematic structural top view of a vaporization bottom base in a second embodiment of an electronic vaporization assembly according to the present disclosure.

In another implementation, the extending direction of the first microgroove 231 intersects with the extending direction of the second microgroove 232, and the first microgroove 231 and the second microgroove 232 are provided at intervals; and the extending direction of the third microgroove 233 intersects with the extending direction of the fourth microgroove 234, and the third microgroove 233 and the fourth microgroove 234 are provided at intervals. FIG. 7 is a schematic structural top view of a vaporization bottom base 22 in a second embodiment of an electronic vaporization assembly 1 according to the present disclosure.

In the second embodiment, a fifth microgroove 235 and a seventh microgroove 237 are provided on the bottom wall 2232 of the third groove 223 of the vaporization base 22. One end of the fifth microgroove 235 is in communication with a vaporization cavity 221, and the other end extends in a direction away from the vaporization cavity 221; and one end of the seventh microgroove 237 is in communication with the vaporization cavity 221, and the other end extends in the direction away from the vaporization cavity 221. The fifth microgroove 235 intersects with the seventh microgroove 237, and an intersection point may be in communication with the vaporization cavity 221, or may be in communication with a first side wall 2131 of the second groove 213, or may be provided between the vaporization cavity 221 and the first side wall 2131 of the second groove 213 (the part of the vaporization base 22 on which the third groove 223 and a fourth groove 224 are provided is completely accommodated in the second groove 213). The fifth microgroove 235 and the seventh microgroove 237 have the same depth and width.

A sixth microgroove 236 and an eighth microgroove 238 are provided on a bottom wall 2242 of the fourth groove 224 of the vaporization base 22. One end of the sixth microgroove 236 is in communication with the vaporization cavity 221, and the other end extends in the direction away from the vaporization cavity 221; and one end of the eighth microgroove 238 is in communication with the vaporization cavity 221, and the other end extends in the direction away from the vaporization cavity 221. The sixth microgroove 236 intersects with the eighth microgroove 238, and an intersection point may be in communication with the vaporization cavity 221, or may be in communication with the first side wall 2131 of the second groove 213, or may be provided between the vaporization cavity 221 and the first side wall 2131 of the second groove 213 (the part of the vaporization base 22 on which the third groove 223 and the fourth groove 224 are provided is completely accommodated in the second groove 213). The sixth microgroove 236 and the eighth microgroove 238 have the same depth and width.

Figure 8:
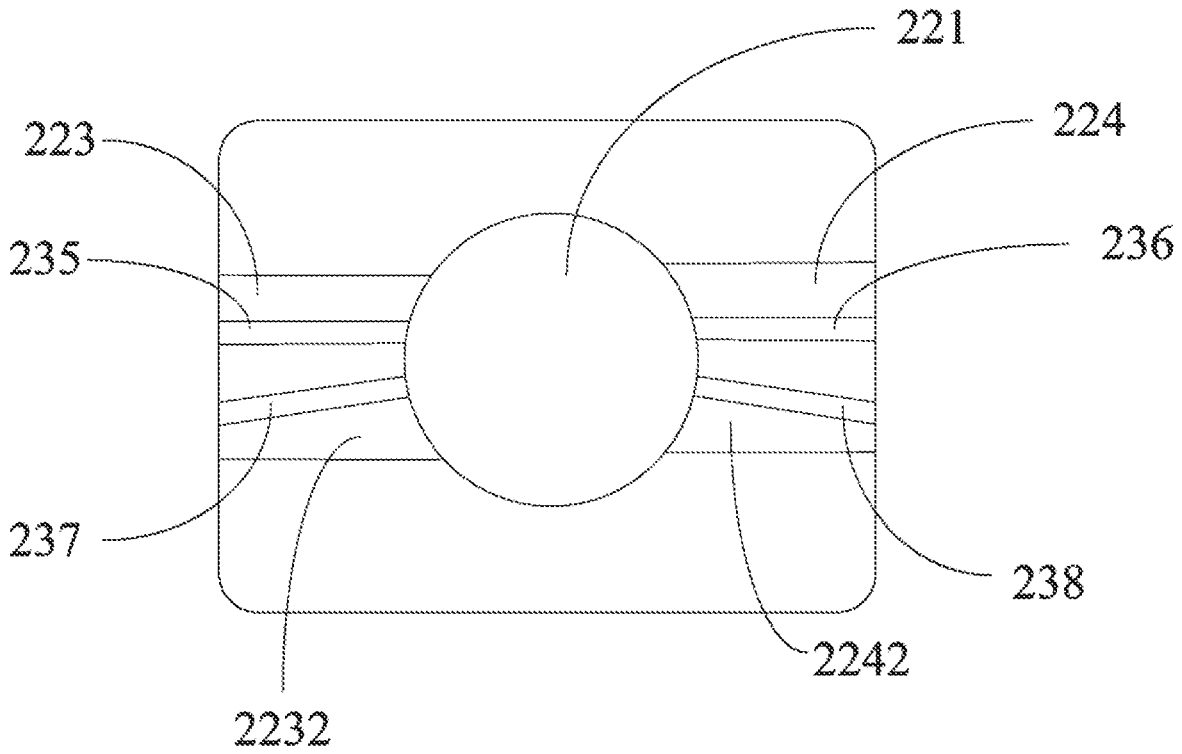
FIG. 8 is a schematic structural diagram of another implementation of a microgroove structure on a bottom wall of a third groove and a bottom wall of a fourth groove of a vaporization bottom base in a second embodiment of an electronic vaporization assembly according to the present disclosure.

FIG. 8 is a schematic structural diagram of another implementation of a microgroove structure 23 on a bottom wall 2232 of a third groove 223 and a bottom wall 2242 of a fourth groove 224 of a vaporization bottom base 22 in a second embodiment of an electronic vaporization assembly 1 according to the present disclosure.

In another implementation, the extending direction of the fifth microgroove 235 intersects with the extending direction of the seventh microgroove 237, and the fifth microgroove 235 and the seventh microgroove 237 are provided at intervals; and the extending direction of the sixth microgroove 236 intersects with the extending direction of the eighth microgroove 238, and the sixth microgroove 236 and the eighth microgroove 238 are provided at intervals.

In other implementations, more than two microgrooves are provided on the bottom wall 2132 of the second groove 213 of the vaporization top base 21 and are provided between the first liquid flowing channel 211 and the vaporization cavity 221, and the more than two microgrooves may intersect with each other or the extending directions thereof may intersect with each other and are provided at intervals. More than two microgrooves are provided between the second liquid flowing channel 212 and the vaporization cavity 221, and the more than two microgrooves may intersect with each other or the extending directions thereof may intersect with each other and are provided at intervals. More than two microgrooves are provided on the bottom wall 2232 of the third groove 223 of the vaporization base 22, and the more than two microgrooves may intersect with each other or the extending directions thereof may intersect with each other and are provided at intervals. More than two microgrooves are provided on the bottom wall 2242 of the fourth groove 224 of the vaporization base 22, and the more than two microgrooves may intersect with each other or the extending directions thereof may intersect with each other and are provided at intervals.

Figure 9:
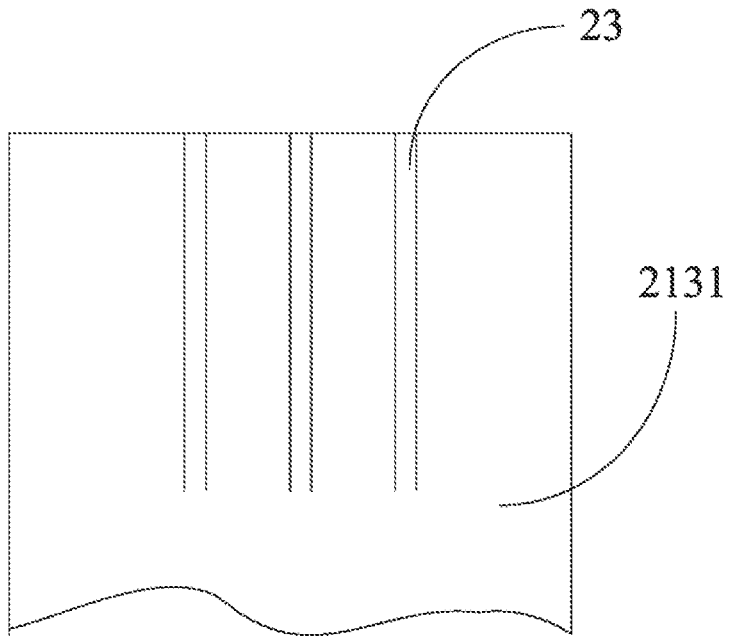
FIG. 9 is a schematic partial structural diagram of a first side wall of a second groove of a vaporization top base in a third embodiment of an electronic vaporization assembly according to the present disclosure.

FIG. 9 is a schematic partial structural diagram of a first side wall 2131 of a second groove 213 of a vaporization top base 21 in a third embodiment of an electronic vaporization assembly 1 according to the present disclosure.

In the third embodiment, a microgroove structure 23 is provided on the bottom wall 2132 of the second groove 213 of the vaporization top base 21, provided between the first liquid flowing channel 211 and the vaporization cavity 221, and provided between the second liquid flowing channel 212 and the vaporization cavity 221; and a microgroove structure 23 is also provided on the first side wall 2131 of the second groove 213 of the vaporization top base 21.

The microgroove structure 23 is provided on the bottom wall 2132 of the second groove 213 of the vaporization base 21, and arrangement of the microgroove structure 23 is the same as those in the first embodiment and the second embodiment, which is not described herein again.

The microgroove structure 23 that is provided on the first side wall 2131 of the second groove 213 of the vaporization top base 21 includes multiple microgrooves. The multiple microgrooves may extend in the axial direction of the electronic vaporization assembly 1, or may extend in a direction perpendicular to the axial direction of the electronic vaporization assembly 1. The multiple microgrooves may be parallel to each other, or the multiple microgrooves may intersect with each other; and the multiple microgrooves may be linear or non-linear.

The microgrooves provided on the first side wall 2131 of the second groove 213 may be in communication with the microgrooves provided on the bottom wall 2132 between the first liquid flowing channel 211 and the vaporization cavity 221; and the microgrooves provided on the first side wall 2131 of the second groove 213 may be in communication with the microgrooves provided on the bottom wall 2132 between the second liquid flowing channel 212 and the vaporization cavity 221.

Figure 10:
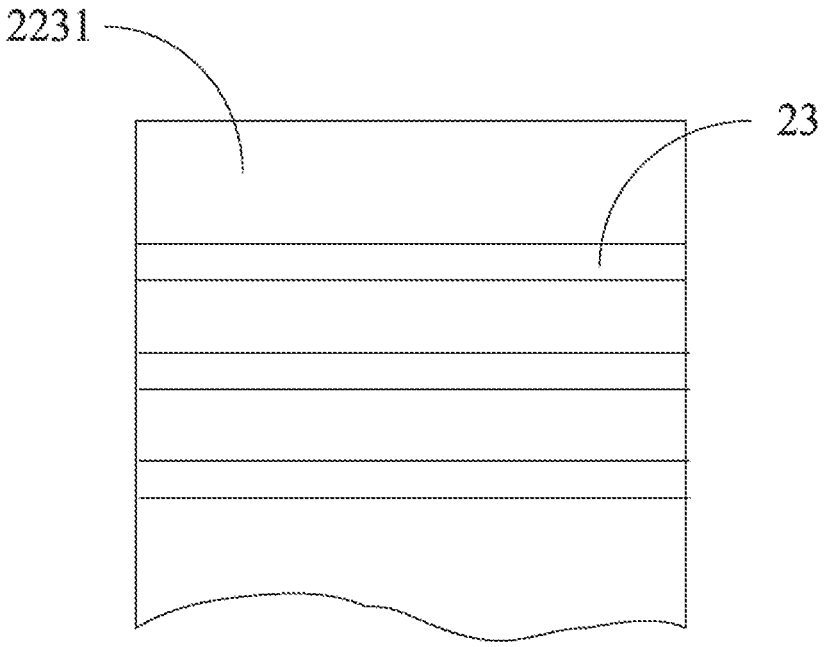
FIG. 10 is a schematic partial structural diagram of a second side wall of a third groove of a vaporization bottom base in a third embodiment of an electronic vaporization assembly according to the present disclosure.

FIG. 10 is a schematic partial structural diagram of a second side wall 2231 of a third groove 223 of a vaporization bottom base 22 in a third embodiment of an electronic vaporization assembly 1 according to the present disclosure.

In the third embodiment, a microgroove structure 23 is provided on the bottom wall 2232 of the third groove 223 and the bottom wall 2242 of the fourth groove 224 of the vaporization base 22, and arrangement of the microgroove structure 23 is the same as those in the first embodiment and the second embodiment, which is not described herein again. In addition, a microgroove structure 23 is also provided on the second side wall 2231 of the third groove 223 and the third side wall 2241 of the fourth groove 224.

The microgroove structure 23 provided on the second side wall 2231 of the third groove 223 and the third side wall 2241 of the fourth groove 224 includes multiple microgrooves, and the multiple microgrooves may be parallel to each other, or the multiple microgrooves may intersect with each other. The multiple microgrooves may extend in a direction close to the bottom wall 2232 or the bottom wall 2242 along an opening of the third groove 223 or an opening of the fourth groove 224, or extend along the vaporization cavity 221 in a direction away from the vaporization cavity 221; and the multiple microgrooves may be linear or non-linear.

The microgrooves provided on the second side wall 2231 of the third groove 223 may be in communication with the microgrooves on the first side wall 2131 of the second groove 213; and the microgrooves provided on the third side wall 2241 of the fourth groove 224 may be in communication with the microgrooves provided on the first side wall 2131 of the second groove 213.

In the first embodiment, the second embodiment, and the third embodiment, the width of the microgroove structure 23 is less than 1 mm, and preferably, ranges from 0.2 mm to 0.5 mm. The section of the microgroove structure 23 is semicircular, rectangular, triangular, or in other shapes, provided that the microgroove structure can finely adjust a liquid supplying amount, which is not limited in this application. In the first embodiment, the second embodiment, and the third embodiment, the microgroove structure 23 on the vaporization top base 21 and the microgroove structure 23 on the vaporization base 22 are provided in different manners, and the manners of providing the microgroove structure 23 on the vaporization base 21 and the microgroove structure 23 on the vaporization base 22 may be randomly combined, which is not limited in this application.

Figure 11:
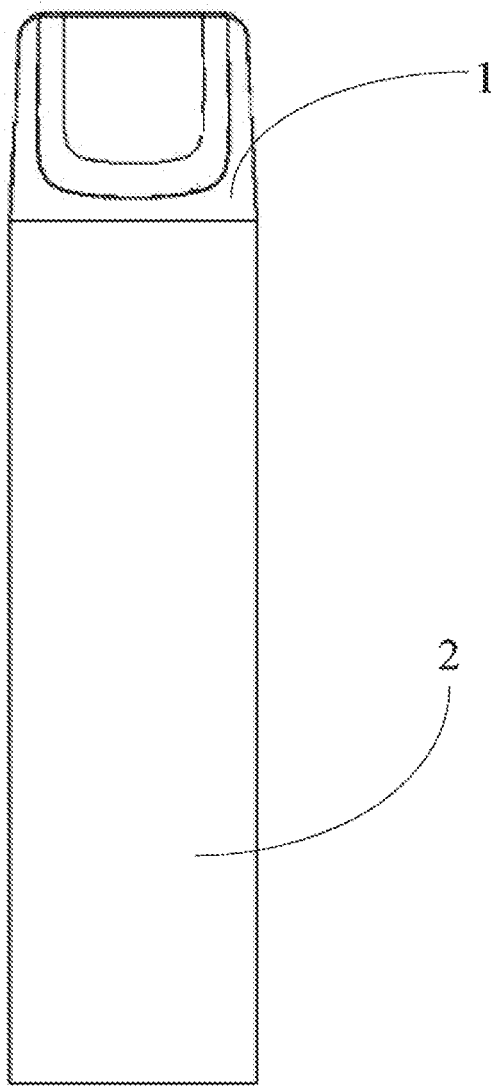
FIG. 11 is a schematic structural diagram of an electronic vaporization device according to the present disclosure.

FIG. 11 is a schematic structural diagram of an electronic vaporization device according to the present disclosure.

The electronic vaporization device includes an electronic vaporization assembly 1 and a power supply component 2. The power supply component 2 supplies power to the electronic vaporization assembly 1, so that the electronic vaporization assembly 1 operates. The electronic vaporization assembly 1 is any of the electronic vaporization assembly 1 in the foregoing embodiments.

In the present disclosure, by providing a microgroove structure 23 on the contact surface between a vaporization base 20 and a vaporization core body 31, a fine adjustment on a liquid supplying amount of e-liquid that enters a vaporization core 30 is achieved, thereby achieving a precise control over the liquid supplying amount of different products, avoiding liquid leakage of the vaporization core 30 caused by an excessive large amount of liquid supplying, or e-liquid explosion of the vaporization core body 30 or a burnt flavor caused by an excessive small amount of liquid supplying, and improving the performance of the electronic vaporization device.

The foregoing descriptions are merely a part of the embodiments of the present disclosure, and the protection scope of the present disclosure is not limited thereto. All equivalent device or process changes made according to the content of this specification and accompanying drawings in the present disclosure or by directly or indirectly applying the present disclosure in other related technical fields shall fall within the protection scope of the present disclosure.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. An electronic vaporization assembly, comprising:

a vaporization core comprising a heating element and a vaporization core body, the vaporization core body having a porous structure;

a vaporization base comprising a vaporization top base, a vaporization bottom base, and a microgroove structure, the vaporization top base and the vaporization bottom base forming a vaporization cavity, the vaporization core being fixed between the vaporization top base and the vaporization bottom base, the microgroove structure comprising a plurality of microgrooves, and the plurality of microgrooves being provided on a surface of at least one of the vaporization top base and the vaporization bottom base in contact with the vaporization core body; and a liquid storage tank sleeved on the vaporization base, wherein the vaporization core spans the vaporization cavity, a fixing portion is provided on each of two sides of the vaporization core, the fixing portions being fixed between the vaporization top base and the vaporization bottom base, and the microgroove structure is in contact with at least one fixing portion of the vaporization core, and wherein the vaporization top base comprises a liquid flowing channel, one end of each microgroove of the plurality of microgrooves being in communication with the liquid flowing channel, and an other end of each microgroove of the plurality of microgrooves being in communication with the vaporization cavity.

2. The electronic vaporization assembly of claim 1, wherein at least two microgrooves of the plurality of microgrooves are parallel to each other, or wherein at least two microgrooves of the plurality of microgrooves intersect each other.

3. The electronic vaporization assembly of claim 1, wherein a width of each microgroove of the plurality of microgrooves is less than 1 mm, and wherein a section of each microgroove of the plurality of microgrooves is semicircular, rectangular, or triangular.

4. The electronic vaporization assembly of claim 1, wherein the vaporization core body comprises a cotton core or a porous ceramic.

5. An electronic vaporization device, comprising:

the electronic vaporization assembly of claim 1; and a power supply component.

6. An electronic vaporization assembly, comprising:

a vaporization core comprising a heating element and a vaporization core body, the vaporization core body having a porous structure;

a vaporization base comprising a vaporization top base, a vaporization bottom base, and a microgroove structure, the vaporization top base and the vaporization bottom base forming a vaporization cavity, the vaporization core being fixed between the vaporization top base and the vaporization bottom base, the microgroove structure comprising a plurality of microgrooves, and the plurality of microgrooves being provided on a surface of at least one of the vaporization top base and the vaporization bottom base in contact with the vaporization core body; and a liquid storage tank sleeved on the vaporization base, wherein the vaporization top base is provided with two liquid flowing channels, the two liquid flowing channels being respectively located on two sides of the vaporization cavity in communication with the vaporization cavity, and wherein two ends of the vaporization core respectively extend into the two liquid flowing channels.

7. The electronic vaporization assembly of claim 6, wherein the vaporization top base is provided with two liquid flowing channels, the two liquid flowing channels being respectively located on two sides of the vaporization cavity in communication with the vaporization cavity, and wherein two ends of the vaporization core respectively extend into the two liquid flowing channels.

8. The electronic vaporization assembly of claim 7, wherein the vaporization cavity comprises a vaporization cavity upper portion and a vaporization cavity lower portion, wherein the vaporization cavity upper portion is located at the vaporization top base and the vaporization cavity lower portion is located at the vaporization bottom base, wherein the plurality of microgrooves comprises a first microgroove and a second microgroove, and wherein the first microgroove and the second microgroove are provided on the vaporization top base and are located on two sides of the vaporization cavity.

* * * * *